US005329733A

United States Patent [19]

Steere, Jr.

[11] Patent Number: 5,329,733

[45] Date of Patent: Jul. 19, 1994

[54] WAFER SLICING AND GRINDING MACHINE AND A METHOD OF SLICING AND GRINDING WAFERS

[75] Inventor: Robert E. Steere, Jr., Boonton, N.J.

[73] Assignee: Silicon Technology Corporation, Oakland, N.J.

[21] Appl. No.: 21,899

[22] Filed: Feb. 24, 1993

Related U.S. Application Data

[62] Division of Ser. No. 575,281, Aug. 30, 1990, Pat. No. 5,189,843.

[51] Int. Cl.[5] ..... B24B 49/00

[52] U.S. Cl. ..... 51/165.76; 51/283 R; 125/13.02

[58] Field of Search ..... 51/165.76, 5 C, 76 R, 51/215 UE, 235, 283 R, 165.71, 165.74; 125/13.02

[56] References Cited

U.S. PATENT DOCUMENTS 3,740,900 6/1973 Youmans et al. ..... 51/235
4,420,909 12/1983 Steere, Jr. ..... 125/13.02
4,852,304 8/1989 Honda et al. ..... 51/5 C
4,881,518 11/1989 Feldmeier ..... 51/5 C
4,896,459 1/1990 Brindt ..... 51/5 C
4,930,262 6/1990 Sennewald ..... 51/165.76
5,025,593 6/1991 Kawaguchi et al. ..... 125/13.02

FOREIGN PATENT DOCUMENTS 62-264835 11/1987 Japan .
0009535 1/1990 Japan ..... 51/5 C

*Primary Examiner*—M. Rachuba
*Attorney, Agent, or Firm*—Francis C. Hand

[57] ABSTRACT

A wafer slicing and grinding machine is provided with a saw blade assembly for the slicing of wafers from an ingot. A grinding stage is also provided for sequentially grinding the rear face of a previously sliced wafer and the front face of an ingot in order to provide a double ground wafer. A transfer chuck and a holding chuck are disposed within the machine to perform movements for effecting a turning over of a wafer for grinding of the rear face of the wafer.

5 Claims, 8 Drawing Sheets

WAFER SLICING AND GRINDING MACHINE AND A METHOD OF SLICING AND GRINDING WAFERS

This is a division of U.S. application Ser. No. 07/575,281 filed Aug. 30, 1990 now U.S. Pat. No. 5,189,843.

This invention relates to a wafer slicing and grinding machine as well as to a method of slicing and grinding wafers.

Heretofore, various types of machines have been known for the slicing of wafers, such as silicon wafers from ingots, for example, cylindrical ingots of silicon. For example, U.S. Pat. No. 4,420,909 describes a wafering system wherein wafers can be severed from an ingot using an internal diameter saw blade.

Because the slicing of wafers from ingots does not always result in a wafer with flat parallel front and back surfaces, it has also been known to grind one or more of the surfaces in order to obtain flat surfaces for the further processing of the wafers, for example, into semiconductor chips. To this end, various proposals have been made for grinding the ingot face prior to or simultaneously with the slicing of a wafer so that at least one face of the wafer is flat. For example, published Japanese Patent Application No. 61-106207 describes a system in which an ingot would be moved relative to a rotating cutting blade as well as a rotating grindstone so that a wafer is sliced from the ingot while being ground on one side at the same time. In an alternative embodiment, the ingot would be cut by the saw blade and thereafter the exposed face ground by a separately mounted grindstone. U.S. Pat. No. 4,852,304 describes a similar system wherein an ingot face is ground by a grind wheel located within a saw blade. German Patent Application OS 36 13 132 describes a system wherein, after a wafer has been sliced by a saw blade, the front face of the ingot is ground by a grinding wheel which projects through the opening of the saw blade. However, in these types of systems, only the front face of a wafer is ground within a slicing and grinding machine.

In order to obtain a flat surface on the rear face of a wafer, it has been known to remove the wafer from a slicing and grinding machine and to grind the rear face on another machine or at another site. For example, European Patent Application 0 221 454 describes a method of producing wafers wherein the end face of an elongated stock is first processed to form a flat surface and thereafter cut. Next, the cut surface of the slice is processed to form a second flat surface using the first flat surface as a reference surface. In describing the manner of processing the cut surface, reference is made to polishing, grinding or cutting of the cut surface, for example by mounting the slice on a vacuum chuck and processing the cut surface by a diameter tool into a flat surface. However, such a process, as described, requires a surface grinding or a surface polishing machine in series with the surface cutting machine so as to provide a processing line. Such a processing line not only requires the use of relatively expensive equipment to perform the separate slicing and grinding operations but also the need move the sliced wafer from one machine to another in a careful manner in the processing line.

Currently, wafer thickness variation during a face grind/slice operation is a combination of grind wheel wear and blade wear. This makes it difficult for an operator to correct or for a machine to identify and automatically correct.

Accordingly, it is an object of the invention to reduce the cost of slicing and grinding wafers.

It is another object of the invention to provide a compact slicing and grinding machine capable of providing wafers with two ground surfaces.

It is another object of the invention to provide a relatively simple technique for the slicing and grinding of opposite sides of a wafer in a single machine.

It is another object of the invention to be able to adjust the slicing and grinding operations of a machine during operation to produce wafers with flat surfaces.

It is another object of the invention to be able to make adjustments in a wafer slicing and grinding machine in a rapid manner.

It is another object of the invention to provide for the detection of wafer thickness variation after grinding both sides and an automatic correction in response to a variation.

Briefly, the invention provides a slicing and grinding machine and a method wherein a wafer can be ground flat on two sides.

The wafer slicing and grinding machine may be constructed with conventional structure including an ingot holder for positioning an ingot in a slicing position, e.g. on a horizontal axis or vertical axis, a saw blade assembly for slicing a wafer from a face of the ingot in the slicing position and a pick-off means for moving a wafer sliced from the ingot to a holding station.

In accordance with the invention, the machine is provided with a holding chuck for holding a wafer with a face thereof in a plane common to the face of the ingot and a grind stage for simultaneously grinding the face of the wafer and the face of the ingot in the common plane.

In addition, the machine is provided with a transfer chuck which acts as holding stage and is movable between the holding station and a transfer position adjacent the holding chuck in order to transfer a wafer from the pick-off means to the holding chuck for subsequent grinding of the second face of the wafer by the grind stage. The transfer chuck is also movable between the transfer position and an unloading station to transfer a ground wafer from the holding chuck to the unloading station for unloading of a ground wafer therefrom.

The saw blade assembly may be constructed with an internal diameter saw blade having a central aperture while the pick-off means is movable through the aperture in order to move a sliced wafer from the ingot to the holding station.

In further accordance with the invention, a conveyor is provided at the unloading station for receiving a wafer having two oppositely ground faces from the transfer chuck. A wafer thickness measurement station is also disposed in the path of the conveyor for measuring the thickness of the wafer thereat. In this case, a control means is connected to the wafer thickness measurement station for receiving data corresponding to the thickness of a wafer. The control means is also connected for example, to the holding chuck to adjust the movement of the holding chuck with a subsequent wafer in order to adjust the thickness thereof.

A registration means is also provided in the path of movement of the holding chuck for indicating a predetermined home position of the chuck relative to the grinding position. This registration means is also connected to the control means to deliver a signal thereto indicative of the chuck moving into the home position in order to permit the control means to index the chuck in programmed manner into the grinding position.

In accordance with the method of the invention, during a single cycle of the slicing and grinding machine, a wafer is held in a grinding position adjacent to an ingot with the face of the wafer and the face of the ingot being disposed in a common plane. A grinding stage is then moved across the face of the wafer and the face of the ingot in simultaneous manner. Once the grinding stage completes the grind, slicing of the ingot for the next wafer begins. Thereat, the double ground wafer is removed from the holding chuck by means of the transfer chuck and transferred to the unloading station.

After a wafer is unloaded, the transfer chuck is moved to the holding position where the pick-off means is holding a wafer which has been previously sliced from the ingot. This wafer is then transferred to the transfer chuck and, thereby, to the holding chuck. In this respect, the previously sliced wafer is rotated from front to back when being transferred from the pick-off means to the holding chuck. That is, the ground front face of the wafer is now positioned against the holding chuck so that the unground rear face is moved to the grinding stage for the grinding of the second face of the wafer.

The next wafer is then severed from the ingot and brought out by the pick-off means to be held in waiting at the holding station to complete the machine cycle.

These and other objects and advantages of the invention will become more apparent from the following detailed description taken in conjunction with the accompanying drawings wherein.

Figure 1:
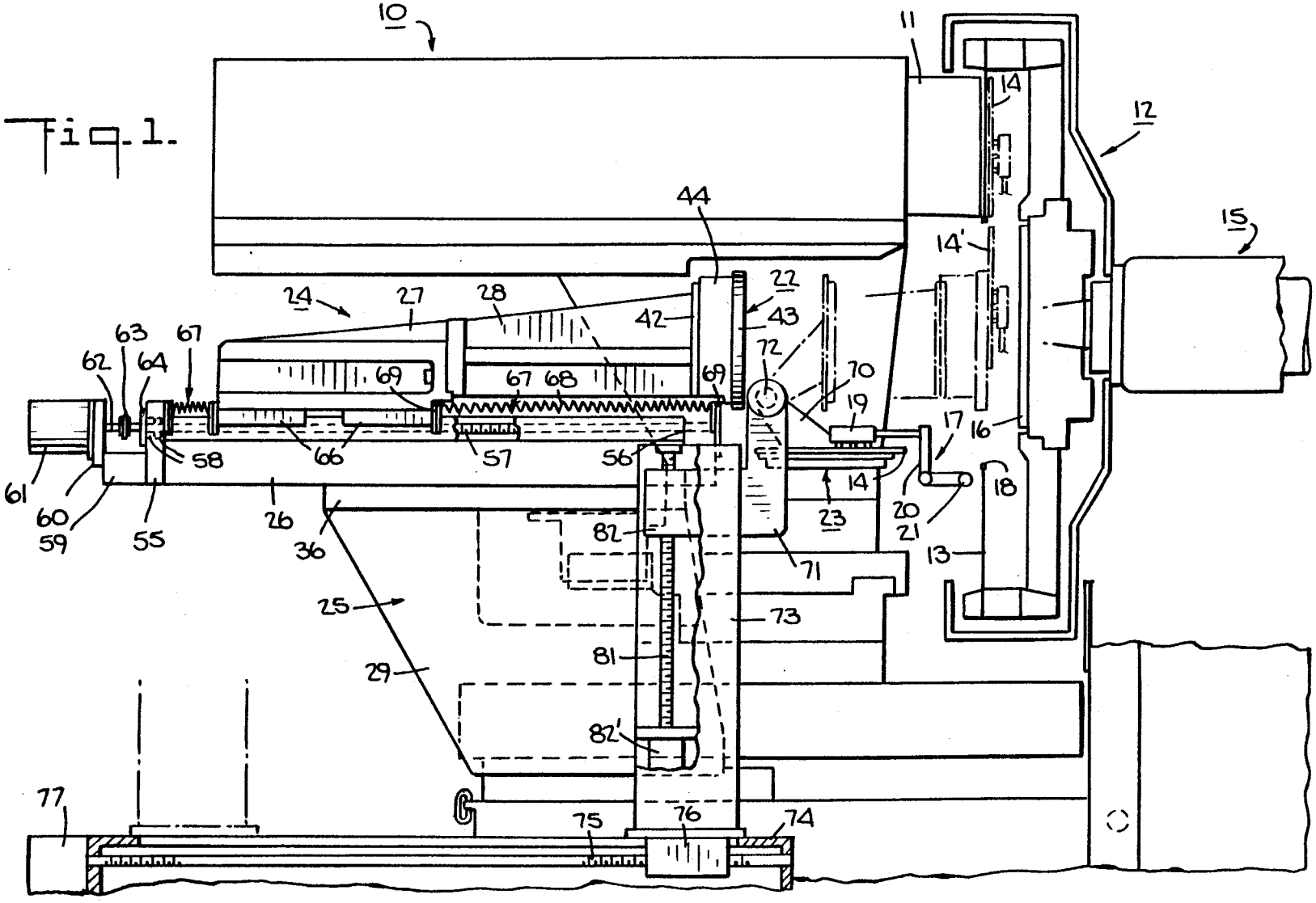
FIG. 1 illustrates a part side view of a wafer slicing and grinding machine constructed in accordance with the invention.
Figure 4:
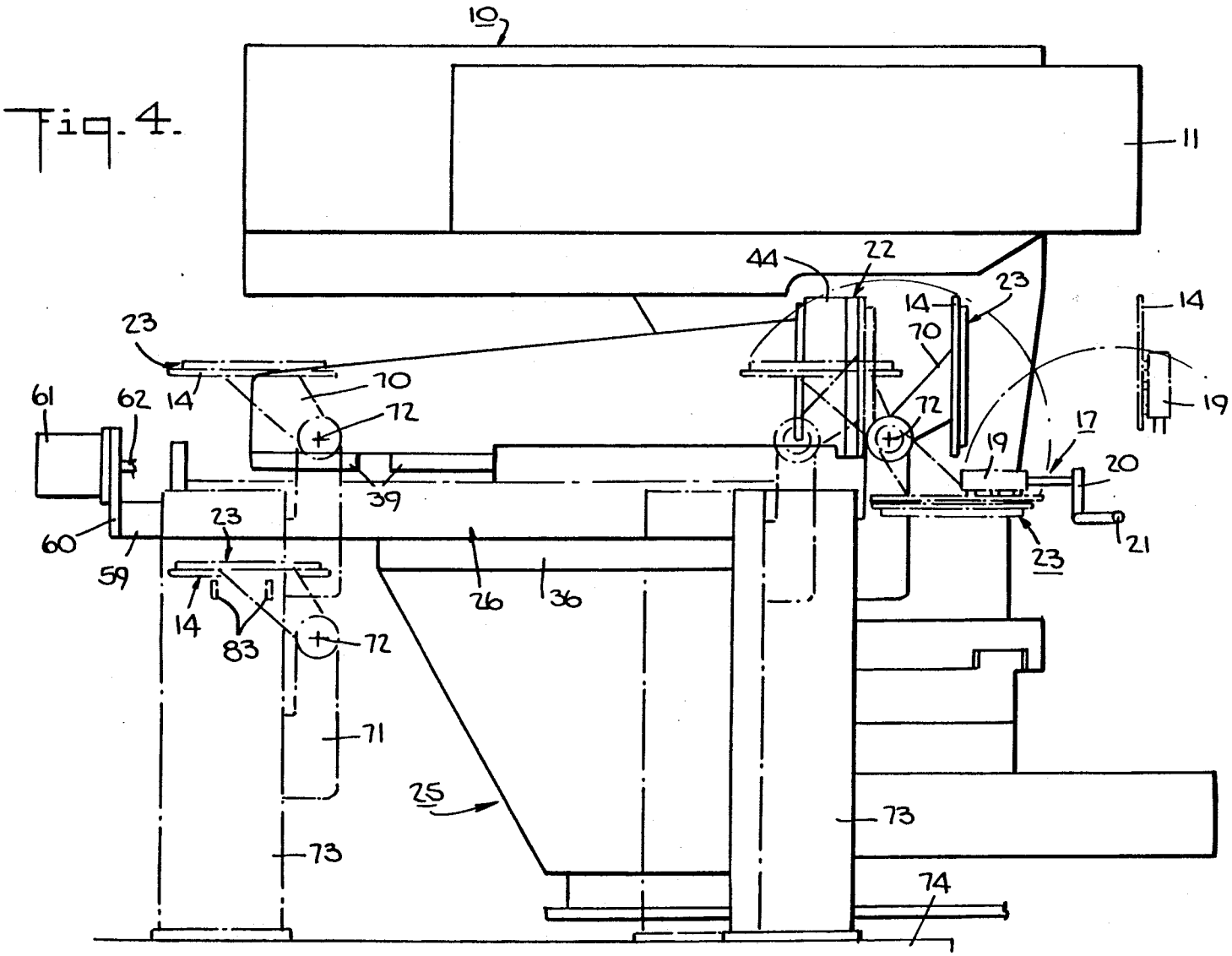
Figure 5:
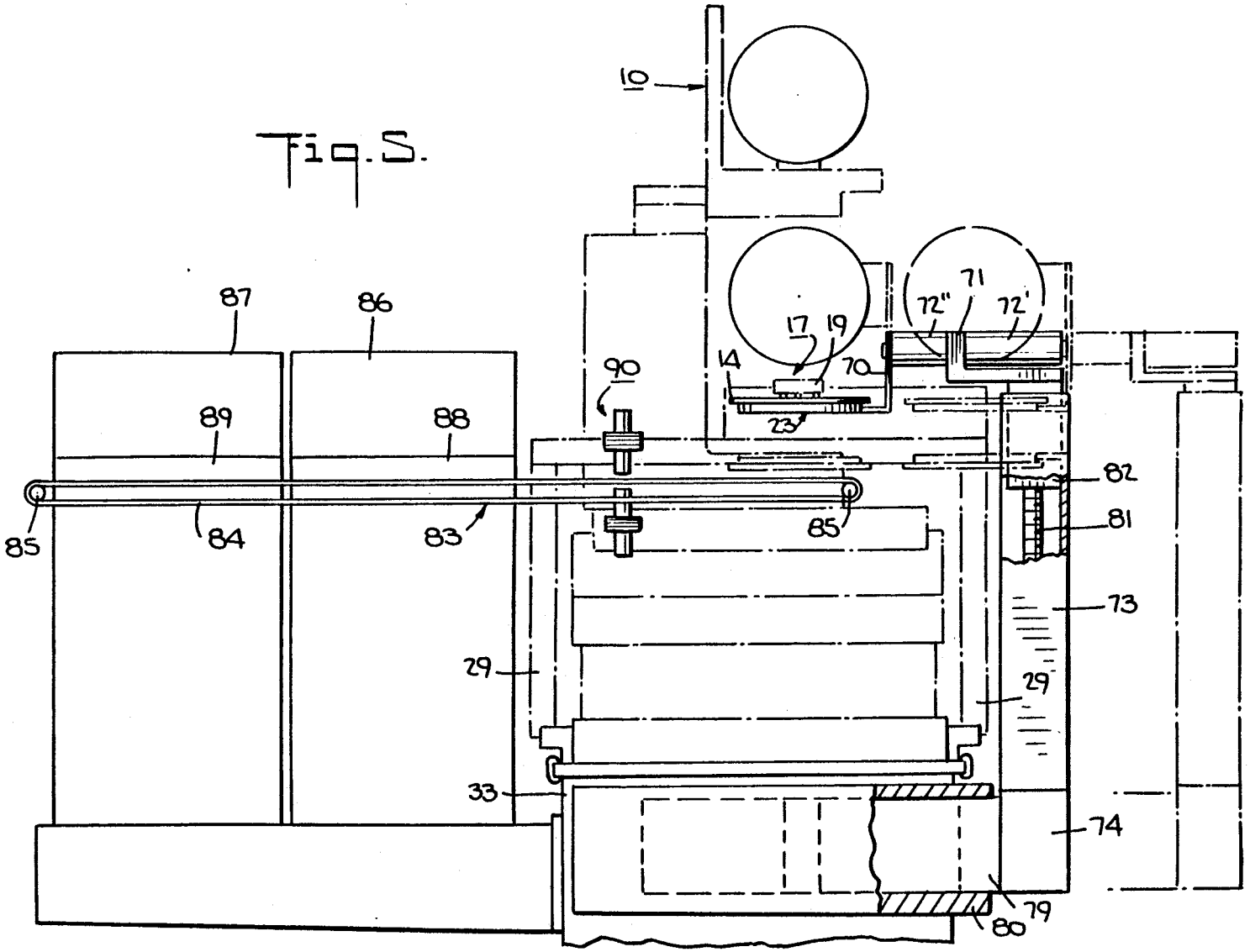
Figure 6:
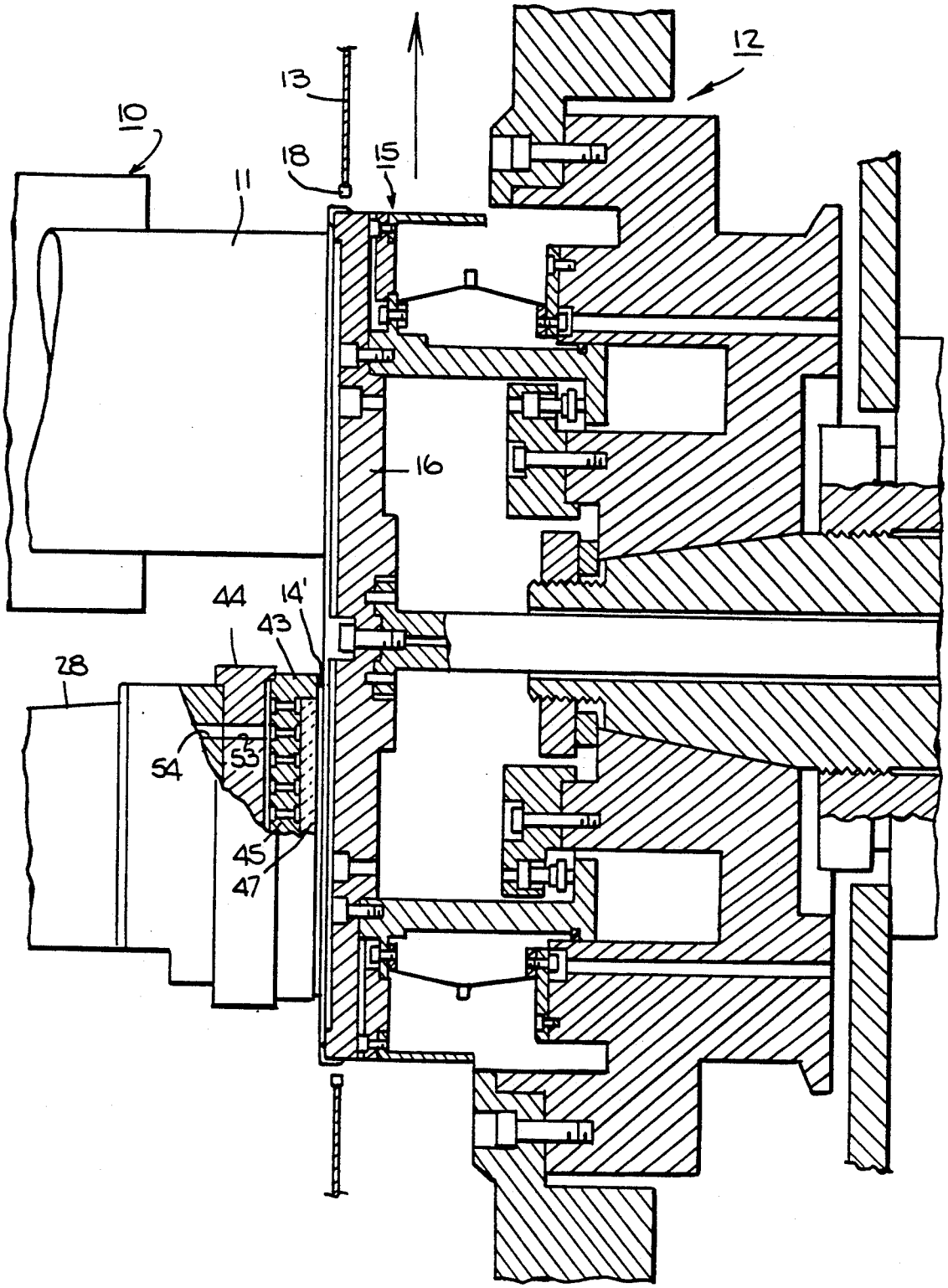
Figure 7:
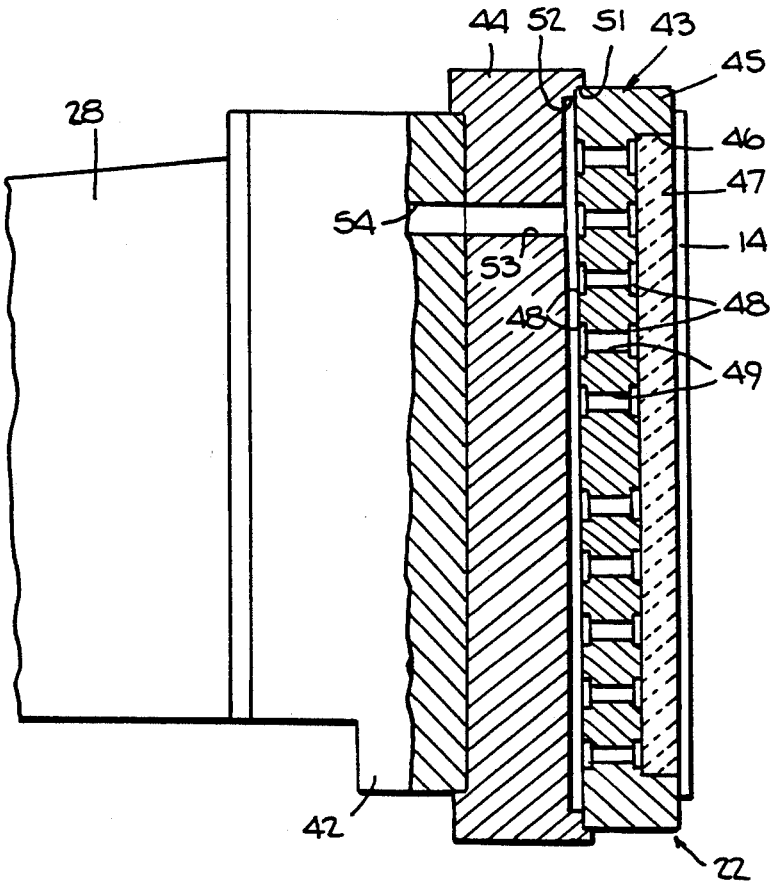
Figure 10:
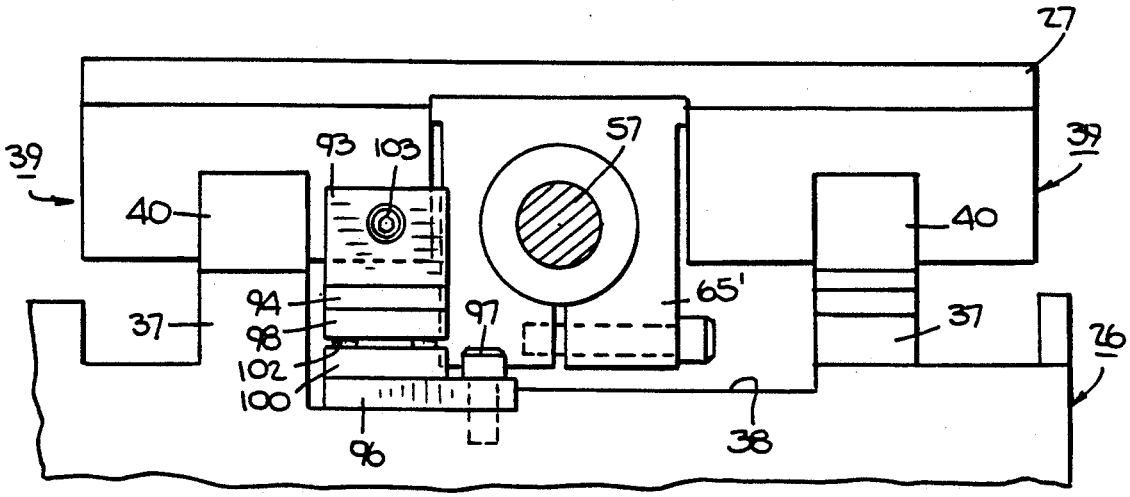
Figure 8:
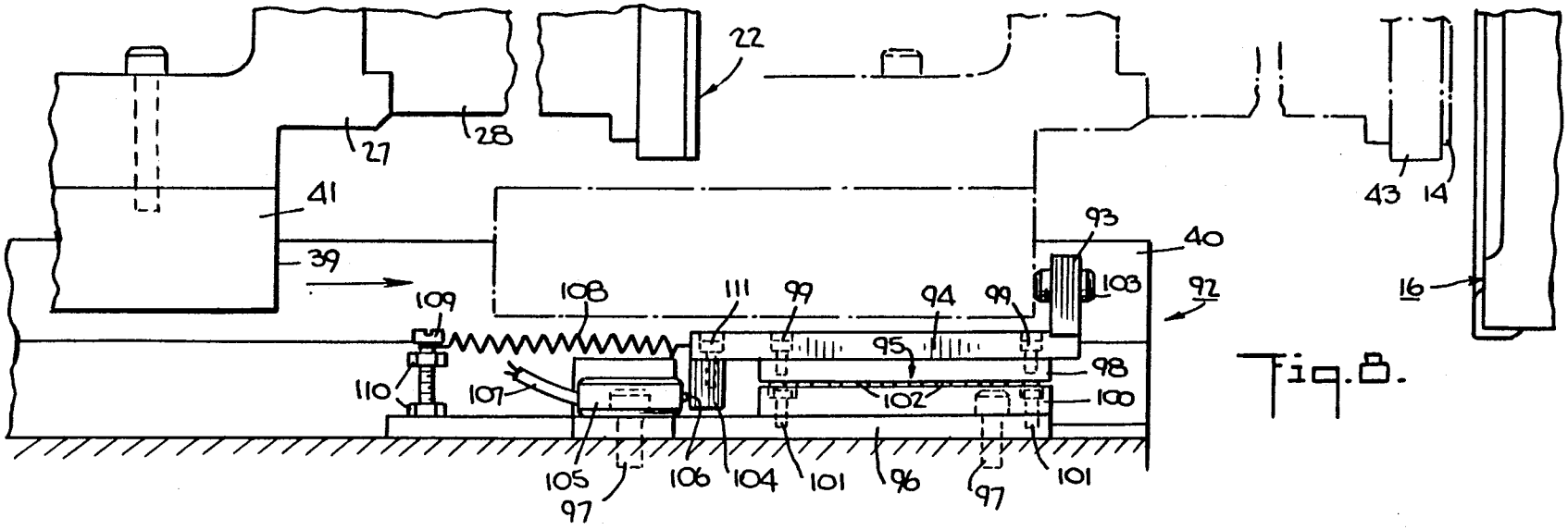
Figure 9:
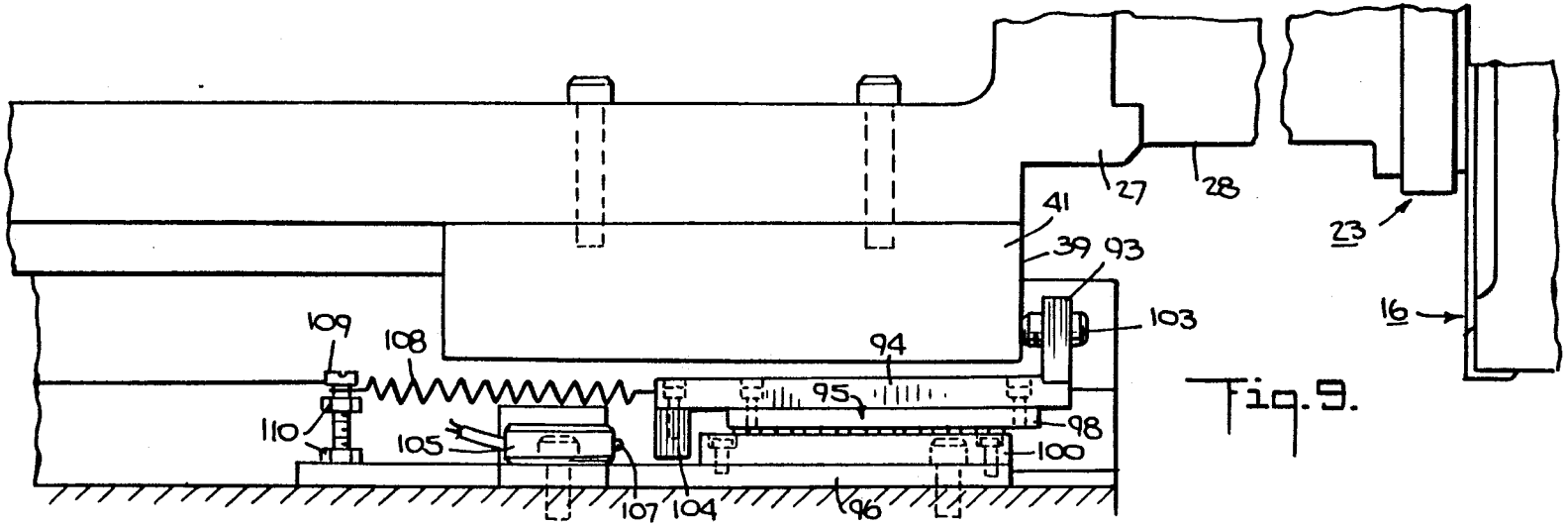

FIG. 4 schematically illustrates the various motions of the transfer chuck and holding chuck of the machine of FIG. 1;

FIG. 5 illustrates an end view schematic of the movements of the transfer chuck in accordance with the invention;

FIG. 6 illustrates a cross sectional view of the grinding stage in a position for the sequential grinding of a face of a wafer and a face of an ingot in accordance with the invention;

FIG. 7 illustrates a cross-sectional view of a holding chuck in accordance with the invention;

FIG. 8 illustrates a partial side view of a registration means for indicating the home position of the holding chuck in accordance with the invention;

FIG. 9 illustrates a view similar to FIG. 8 of the holding chuck in the grinding position; and FIG. 10 illustrates an end view of the registration mean of FIGS. 8 and 9.

Referring to FIG. 1, the wafer slicing and grinding machine includes an ingot holder box 10 of conventional structure for positioning an ingot 11 in a slicing position, for example, on a horizontal axis, In addition, the machine employs a saw blade assembly 12 of conventional structure having an internal diameter saw blade 13 for slicing a wafer 14 from the ingot 11 positioned at the slicing position during one phase of a machine cycle. The machine also includes a grind stage 15 of conventional structure, for example, as described in pending U.S. patent applications Ser. Nos. 07/353,879 filed May 18, 1989 and 07/525,466 filed May 18, 1990. The grind stage 15 includes a grind wheel 16 disposed coaxially of the saw blade 13 for grinding a face of the ingot 11 positioned at the slicing position during a second phase of the machine cycle.

During operation, the saw blade assembly 12 moves downwardly relative to the ingot 11 during one phase of a machine cycle in order to slice a wafer 14 from the ingot 11. During a second phase of the machine cycle, the assembly 12 moves upwardly while the grind stage 15 effects grinding of the front face of the ingot 11. For this machine, the grind wheel 16 may be separately adjusted relative to the blade 13 to assure that the grind wheel projects 0.010" to 0.100" beyond the blade 13 toward the ingot 11 when registered for grinding; the grind wheel 16 would also be adjusted to assure zero runout or wobble of the grinding surface.

As shown in FIG. 1, the machine also includes a pick-off means 17 of conventional structure for moving a wafer sliced from the ingot 11 through an aperture 18 in the saw blade 13 to a holding station shown in solid line in FIG. 1. As indicated, the pick-off means 17 includes a suction head 19 which is mounted on a pivot arm 20 for pivoting on an axle 21 disposed on a horizontal axis. As indicated, the pick-off suction head 19 is pivotable from the holding position shown in solid line in FIG. 1 through the aperture 18 in the saw blade 13 and movable upwardly to a pick-off position shown in dotted line, facing the wafer 14 being sliced from the ingot 11.

The pick-off means 17 is constructed in a manner as described in U.S. Pat. No. 4,420,909 and need not be further described.

Referring to FIGS. 1 and 6, the machine includes a holding chuck 22 and a transfer chuck 23 to effect grinding of the rear face of a wafer 14 sliced from an ingot 11. Briefly, the holding chuck 22 is operated after a second wafer 14 which has been sliced from the ingot 11 is moved into the holding station by the pick-off means 17. At this time, the holding chuck 22 with a previously sliced wafer 14' thereon is brought into the grinding station facing the grind stage 15 as shown in dotted line in FIG. 1 by moving in a direction parallel to longitudinal axis of the holding chuck 22. At this time, the unground face of the wafer 14' is aligned in the same plane as the now unground face of the ingot 11. Thereafter, the grind stage 15 is deployed so as to grind the face of the wafer 14' as well as the face of the ingot 11 in a simultaneous manner during a second phase of the machine cycle, i.e. during upward movement of the saw blade assembly 12. The ingot and wafer 14' are ground simultaneously in unison. In other words, the ingot is ground by the outer periphery of the raised cutting rim on the grind wheel 16 while the wafer 14' is ground by the inner periphery of the raised rim of the grind wheel 16.

After the grinding operation has been completed, the saw blade assembly 12 begins to move downwardly during the initial phase of the next machine cycle so as to begin slicing the next wafer from the ingot 11. At the same time, the holding chuck 22 retracts to a retracted (transfer) home position and the transfer chuck 23 moved so as to transfer the now completely ground wafer 14' from the holding chuck 22 to an unloading station to the rear end of the ingot holder 10. After unloading of the wafer 14', the transfer chuck 23 moves to the holding station below the pick-off suction head 19 in order to receive and transfer the wafer 14 thereat to the holding chuck 22. In this way, the wafer 14 which has been previously ground on one face and sliced is rotated from front to back relative to the grind stage 15 so that the rear face of the wafer can now be ground.

After the next sliced wafer is moved by the pick-off means into the holding station, the holding chuck 22 with the wafer 14 thereon moves into the grinding position to begin the next cycle.

Figure 2:
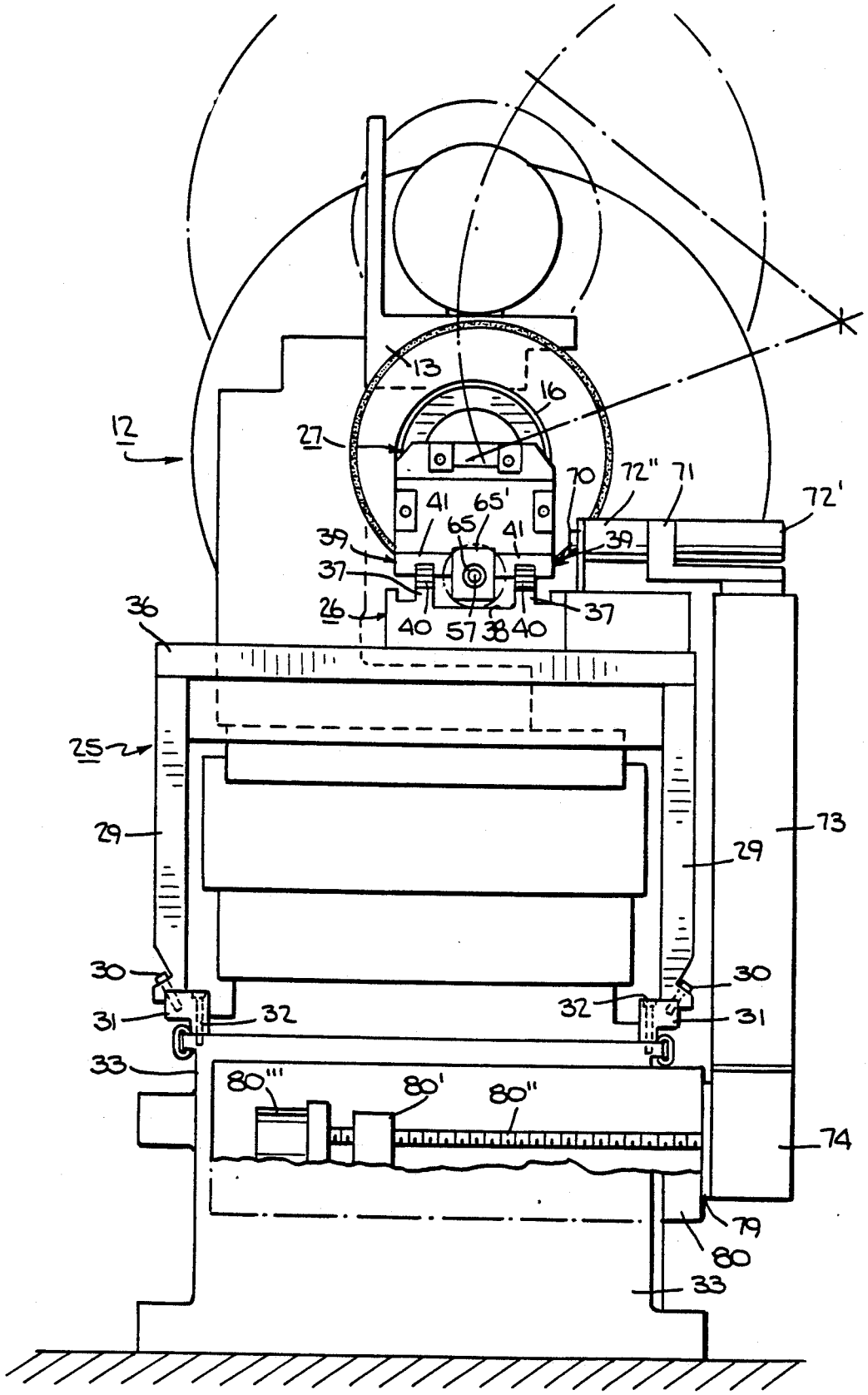
FIG. 2 illustrates an end view of the machine of FIG. 1.

Referring to FIGS. 1 and 2, a chuck assembly 24 is provided as a means for supporting and moving the holding chuck 22 between the retracted transfer position shown solid line and the grinding position shown in dotted line in FIG. 1. This chuck assembly 24 includes a generally U-shaped main support bracket 25, a carriageway 26 supported on the bracket 25, a carriage block 27 slidably mounted on the carriageway 26, and an extension bracket 28 mounted on the carriage block 27.

The support bracket 25 has a pair of depending side walls 29 each of which is secured by a series of bolts 30 (see FIG. 2) to a bar 31 which, in turn, is secured by bolts 32 to a base 33 of the machine. The main support bracket 25 also has a base plate 36 which is secured to and across the upstanding side walls 29. The base plate 36, in turn, supports the carriageway 26.

As indicated in FIG. 2, the carriageway 26 is bolted to the plate 36 and is provided with a pair of upstanding shoulders 37 with a recess 38 between the shoulders 37. The shoulders 37, in turn, each support a pair of slide bearings 39, such as linear roller way H series bearings sold by Nippon Thompson Co., Ltd. Each slide bearing 39 includes a track rail 40 which is secured as by bolts (not shown) to a shoulder 37 of the carriageway 26, two sliders 41 which are slidably mounted on the rail 40 and preloaded roller bearings (not shown) between each slider 41 and track rail 40 to accommodate sliding therebetween. Each bearing slider 41 is also bolted to the underside of the carriage block 27. In this way, the carriage block 27 is able to slide longitudinally along the carriageway 26.

As shown in FIG. 1, the carriage block 27 carries the extension bracket 28 at a forward end in cantilever manner. As indicated, the extension bracket 28 has a circular end plate 42 at the free end which is sized to receive the holding chuck 22.

Referring to FIG. 7, the holding chuck 22 is secured to the plate 42 by mean of a plurality of peripherally disposed bolts (not shown) and includes a vacuum chuck 43 and an adapter 44 for mounting the vacuum chuck 43 on the end plate 42 of the extension 41.

The vacuum chuck 43 is constructed of a solid ceramic holder 45 having a recess 46 on one side receiving a porous ceramic disc 47. In addition, the solid ceramic holder 45 is provided with concentric annular grooves 48 on each side which are interconnected via suitable bores 49. The porous ceramic disc 47 is held by any suitable bonding means within the recess 46 of the holder 45. The vacuum chuck 43 is also held by suitable bonding means to the adaptor 44.

The adapter 44 is provided with a recess 51 in a front face for receiving the vacuum chuck 43 as well as with a pair of crossing grooves 52 (only one of which is shown) so as to communicate with the annular grooves 48 in the rear face of the vacuum chuck 43. In addition, the adaptor 44 is provided with a bore 53 which passes through the adapter 44 so as to communicate with the crossing grooves 52 on the front face and with a bore 54 in the cylindrical end plate 42 of the extension bracket 28. By applying a suction force through a suction line (not shown) via the bore 54, a vacuum can be generated at the face of the vacuum chuck 43 in order to hold a wafer 14 thereon.

Referring to FIG. 1, a means is also provided for moving the carriage block 27 longitudinally of the carriageway 26. To this end, a pair of blocks 55, 56 are secured at opposite ends of the carriageway 26 as by bolts (not shown) and a threaded lead screw 57 is rotatably mounted at the ends in each block 55, 56. In addition, a pair of preloaded thrust bearings 58 are provided within the block 55 at the left-hand end of the carriageway 26 as viewed in FIG. 1 to receive the end of the lead screw 57 therein. In addition, a mounting block 59 is secured to the bearing block 55 along with a mounting plate 60 on which a stepper motor 61 is secured. The stepper motor 61, in turn, has a drive shaft 62 which passes through an aperture in the mounting plate 60 for coupling with an end of the lead screw 57 via a coupling 63. A suitable ring clamp 64 is also provided about the lead screw 57 to retain the bearings 58 within the bearing block 55.

Referring to FIG. 2, a threaded nut 65 is secured via nut clamp block 65' which also serves as the rear slide bearing pair alignment block to the underside of the carriage block 27 to project into the recess 38 of the carriageway 26 and to threadably engage about the lead screw 57 in known manner. In this respect, rotation of the lead screw 57 causes the carriage block 27 to move longitudinally of the carriageway 26. As indicated in FIG. 2, the nut 65 and nut clamp block 65' are disposed between the pairs of slide bearings 39.

Referring to FIG. 1, a block 66 is provided on the underside of the carriage block 27 to provide for front slide bearing pair alignment.

Referring to FIG. 1, a bellows type seal 67 is disposed between each bearing block 55, 56 and the carriage block 27 in order to seal the lead screw 57 and the carriage slide bearing environs from dirt and debris. Each bellows seal 67 is constructed in a conventional fashion so as to expand longitudinally of the carriageway 26. To this end, each bellows seal 67 is made of an expandable bellows member 68 and mounting plates 69 at opposite ends for securing the bellows 68 to a respective bearing block 55, 56 and to the carriage block 27.

Figure 3:
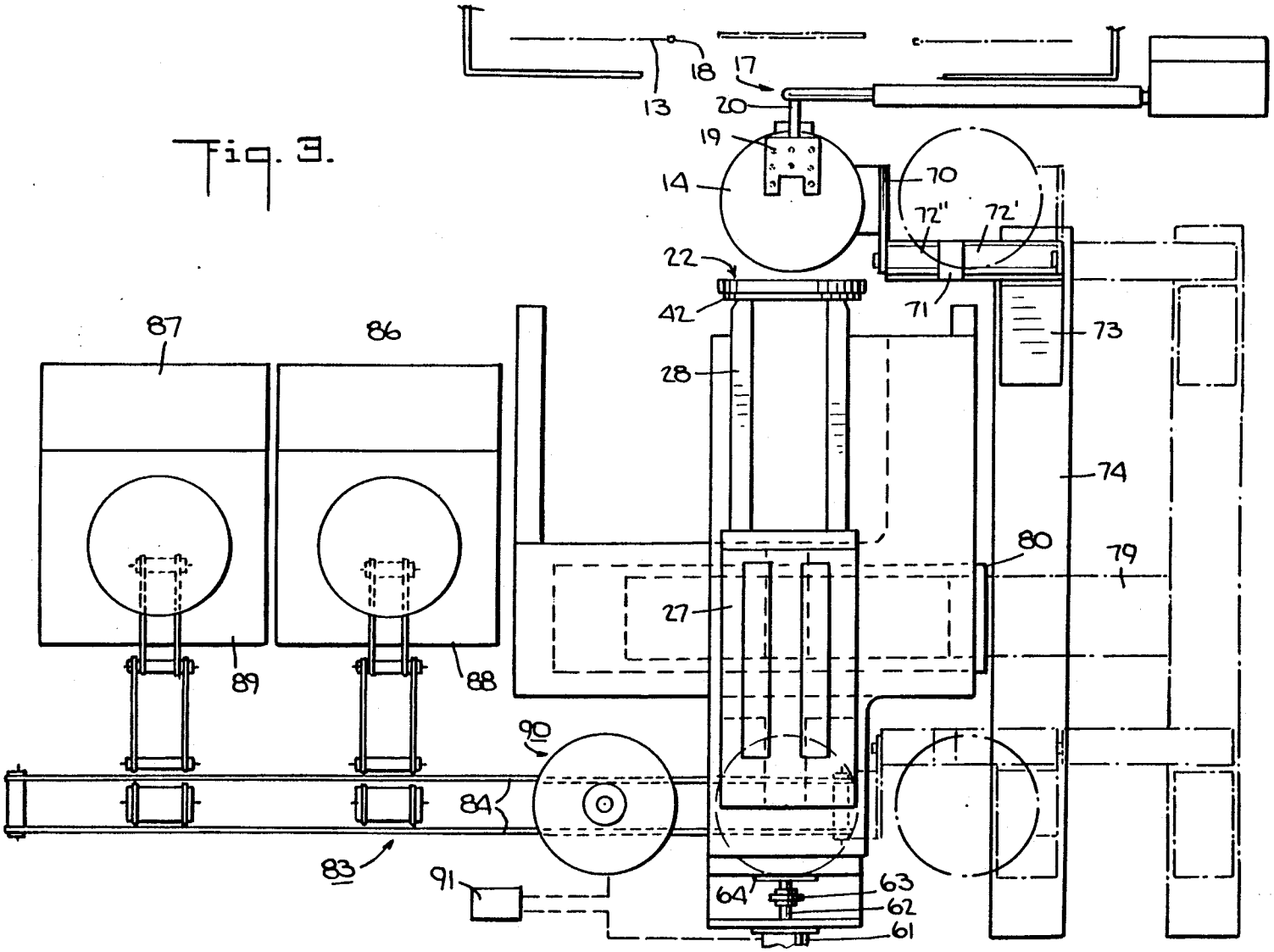
FIG. 3 illustrates a plan view of the machine of FIG. 1.

Referring to FIGS. 1 and 3, the transfer chuck 23 is in the form of a circular disc of plastic with concentric grooves (not shown) on the front face. In addition, radial grooves (not shown) connect the concentric grooves and extend to a central hole. The central hole, in turn, connects axially to an internal bore which, in turn, is connected to a vacuum source. The transfer chuck 23 is flex mounted on a pivot arm 70 in order to allow some axial movement under pressure. This will prevent excessive force on a wafer when the chucks 23, 22, come together during a wafer transfer. As indicated, the pivot arm 70 is pivotally mounted on a bracket 71 for rotating about a horizontal axis 72 via a step motor 72' (see FIG. 2) and harmonic gear reduction 72''. A suitable suction line (not shown) communicates with the holding chuck 23 so as to effect a suction force sufficient to retain a wafer thereon. As indicated in FIG. 1, the holding chuck 23 is pivotal between a horizontal position below the holding station of a wafer 14 on the pick-up means 17 and a vertical position as shown in dotted line. As indicated in FIG. 4, the holding chuck 23 may also be pivoted into an upside-down horizontal position at the unloading station.

The bracket 71 is mounted on an upright guideway member 73 which, in turn, is slidably mounted at the base in a guideway 74 for movement longitudinally of the machine. As shown in FIG. 1, a threaded lead screw 75 is disposed longitudinally within the guideway 74 while a threaded nut 76 is secured to the base of the upright member 73 and threaded unto the lead screw 75. Upon rotation of the lead screw 75, for example via a step motor 77, the nut 76 and thus, the vertical member 73 are movable longitudinally of the machine.

Referring to FIG. 3, the guideway 74 is secured to a means for moving the guideway 74 and, thus, the transfer chuck 23 laterally relative to the axis of the ingot box 10 and the holding chuck 22. This means includes a reciprocating guided member 79 which is secured to the guideway 74 and guided in a guideway 80 which, in turn, is mounted to the base 33 of the machine. The reciprocating member 79 is secured to a nut 80' which is threaded on a lead screw 80" driven by a motor 80"' located within the guideway 80. Thus, movement of the guideway 74 from the solid line position shown in FIG. 3 to the dotted line position causes the transfer chuck 23 to move laterally away from the holding position of the pick-off means 17 as well as clear of the holding chuck 22. This movement allows the transfer chuck 23 to pivot upwardly from the holding station, for example, over an angle of 90°, so as to bring the wafer 14 thereon into a position to clear the pick-off means 17. Rotation of the lead screw 75 (see FIG. 1) then permits the vertically positioned wafer 14 to be brought into engagement with the holding chuck 22, after the guideway 74 has been returned to the retracted position shown in solid line in FIG. 3. Alternatively, with the guideway 74 retained in the extended dotted line position shown in FIG. 3, the lead screw 75 (see FIG. 1) can be rotated so as to cause the transfer chuck 23 and the upright member 73 to move to the unloading position of the machine.

Referring to FIGS. 1 and 5, the upright member 73 is also provided with an internally disposed vertical lead screw 81 and a nut 82 which is secured to the pivot arm bracket 71 so as to move the bracket 71 vertically in response to rotation of the lead screw 81 for example via a step motor 82'.

Referring to FIGS. 3 and 5, a conveyor 83 is disposed at the unloading station of the machine for receiving a wafer 14 from the transfer chuck 23. As illustrated, the conveyor 83 is formed of a pair of parallel endless belts 84 which are disposed about pulleys 85 at opposite ends. As also indicated, when the transfer chuck 23 is moved into the unloading position, the chuck 23 is disposed directly over the right-hand end of the conveyor 83. Upon release of suction from the transfer chuck 23 the wafer 14 is deposited onto the conveyor belts 84 and moved therealong to one of two stations 86, 87 at which the wafers can be removed for loading onto a wafer load elevator 88, 89 as is known.

Referring to FIG. 5, a wafer thickness measurement station 90 is disposed in the path of the conveyor 83 for measuring the thickness of a wafer 14 thereat. The measurement station 90 employs a known thickness gauge, such as an Air Follower Pneumatic Servo-mechanism supplied by Schaevitz Engineering of Pennsauken, New Jersey for measuring the wafer thickness, A control means in the form of a central computer 91 (see FIG. 3) is also connected to the wafer thickness measuring station 90 for receiving data therefrom corresponding to a thickness of a wafer thereat. The control means 91 is also connected to the motor 61 for moving the holding chuck 22 in order to adjust the grinding of a subsequently processed wafer in order to adjust the thickness thereof. During production, the data from the thickness gauge would look for a statistical trend toward thicker wafers. This tells the machine that the grind wheel 16 is wearing. Once the trend is confirmed, the machine will adjust via the signal to move the holding chuck 22 slightly closer to the grind wheel 16 automatically. As the cutting blade wears, the wafers upstream of the second grind automatically get thicker. The machine can be programmed to make periodic checks on this by running a wafer through without grinding the second side (or do it manually). The capability to automatically distinguish between grind wheel and blade wear is an important feature of this machine. Of course, in the event any wafer or wafers exceed maximum specifications for thickness, plus or minus, the machine would automatically go to a fault mode.

The grind stage 15, or more specifically the grind wheel 16, always moves to a fixed registration position (i.e. 3 point tripod stop).

Referring to FIG. 8, a registration means 92 is provided in the path of movement of the holding chuck 22 for indicating a predetermined home position of the holding chuck 22 relative to the grinding position. This registration means 92 is connected to the control means 91 in order to deliver a signal thereto indicative of the holding chuck 22 moving into the home position, i.e. the dotted line position illustrated in FIG. 8, in order to permit the control means 91 to index or otherwise move the holding chuck 22 in programmed manner into the grinding position shown in FIG. 9.

Referring to FIGS. 8 and 10, the registration means 92 is mounted on the carriageway 26 within the recess 38 between the upstanding shoulders 37. As indicated, the registration means 92 is disposed in the path of one of the bearing sliders 41 of the slide bearings 39 secured to the underside of the carriage block 27.

The registration means 92 includes an upstanding abutment block 93 located in the path of the indicated bearing slider 41 and bolted to a mounting plate 94 which, in turn, is mounted via a linear slide bearing 95 on a mounting plate 96 secured as by bolts 97 to the carriageway 26 within the recess 38. As indicated, the bearing 95 has an upper race 98 secured as by bolts 99 to the mounting plate 94 while the lower race 100 is secured as by bolts 101 to the lower mounting plate 96. In addition, a plurality of rolling elements 102 are provided between the races 98, 100.

An abutment screw 103 is threadably mounted in the abutment block 93 for abutting the bearing slider 41 which is secured to the carriage block 27 of the holding chuck 22. This screw 103 may be adjusted as so as adjust the point at which the carriage block 27 would move into abutment with the screw 103 and, thus, adjust the "home" position of the holding chuck 22.

A second abutment block 104 is also secured as by bolts (not shown) in depending manner from the mounting plate 94 at an opposite end from the abutment block 93. This second abutment block 104 faces a limit switch 105 such as a Veeder Root No. 748520-007 registration switch. The limit switch 105 is secured to the mounting plate 96 as by bolts (not shown) and includes a contact reciprocally mounted plunger 106 which faces the dependent abutment block 104 and which is biased outwardly. This limit switch 105 is also connected by a suitable line 107 to the control means 91 in order to deliver a signal thereto indicative of the holding chuck 22 arriving at the home position as illustrated in dotted line in FIG. 8.

A spring 108 is secured at one end to a mounting screw 109 threaded into the lower mounting plate 96. As indicated, a pair of nuts 110 are threaded on the screw 109. The lower nut 110 serves to lock the mounting screw 109 to the mounting plate 96 while the upper nut 110 serves to clamp the spring 108 in place. The opposite end of the spring 108 is secured by a screw 111 to the mounting plate 94 of the abutment block 93. This spring 108 serves to bias the dependent abutment block 104 against the contact plunger 106 of the limit switch 105.

In use, the abutment screw 103 is adjusted within the abutment block 93 to establish a predetermined home position for the holding chuck 22 relative to the grinding position of the grind wheel 16. When the holding chuck 22 is moved in towards the grinding position from a retracted position as indicated in solid line in FIG. 8, the bearing slide 41 depending from the carriage block 27 abuts the screw 103.

Continued movement of the holding chuck 22 then causes the abutment block 93 and mounting plate 94 to move with the holding chuck 22 towards the grind wheel 16. This movement is permitted by the upper race 97 of the bearing also moving in the same direction. At the same time, the spring 108 elongates while the contact plunger 106 is released to move into an outwardly biased position thereby causing the limit switch 105 to emit a signal to the control means 91 (not shown) to indicate that the holding chuck 22 has reached the home position and is now moving towards the grind wheel 16. At this time, the control means 91 programs the movement of the transfer chuck 22 via the motor (not shown) for moving the same. The holding chuck 22 is then moved a predetermined incremental amount so as to move the wafer on the vacuum chuck 43 into the grinding position at the grinding wheel 16 as indicated in FIG. 9.

The central computer 91 is provided to coordinate all the functions of the machine to slice and grind both sides of a wafer perfectly flat and parallel within a range of 3 microns or less. The computer coordinates and controls the normal machine function such as, ingot indexing, saw blade slicing, face grind and the like and now integrates these functions with the double grind functions. The double grind functions include wafer thickness measurements and interpretation to automatically index the holding chuck 22, i.e. holding stage, the proper amount for positioning a wafer against the grind wheel 16. The computer also controls the transfer chuck movement and controls the loader elevator stations and the like.

In use, an ingot 11 mounted within the ingot holder 10 is first face ground and then moved into a slicing position within the saw blade assembly 12. The saw blade assembly 12 is then moved downwardly to effect slicing of a wafer 14 from the face of the ingot 11. Near the conclusion of slicing, the pick-off means 17 is moved into a position facing the wafer 14 so that upon completion of the slicing operation, the wafer 14 can be subsequently moved through the blade 13 into the holding position of the pick-off means 17 shown in solid line in FIG. 1. At this time, the transfer chuck 23 is positioned below the pick-off means 17 so as to receive the wafer 14. After a transfer has been effected, for example by releasing suction within the suction head 19 of the pick-off means, and creating a suction force in the transfer chuck 23, the transfer chuck 23 is moved laterally out of the plane of the pick-off means 17, for example, into the dotted line position shown in FIG. 3. The transfer chuck 23 is then pivoted via the pivot arm 70 into the vertical position as shown in dotted line in FIG. 1. Next, the transfer chuck 23 is moved laterally so that the transfer chuck 23 is aligned with the holding chuck 22. The upright member 73 is then moved toward the rear end of the machine in incremental amounts so as to bring the wafer 14 on the transfer chuck 23 into facing engagement with the holding chuck 22. Vacuum is then applied on the holding chuck 22 while vacuum is released from the transfer chuck 23 so as to affect a transfer of the wafer 14 onto the holding chuck 22.

Thereafter, the transfer chuck 23 is moved away from the holding chuck 22 and moved laterally into the dotted line position shown in FIG. 3.

At the beginning of a machine cycle with the face of the ingot 11 having been ground, the saw blade 13 is moved downwardly to begin slicing a wafer. After slicing through most of the ingot 11, the pick-off means 17 moves into the pick-off position and retrieves the sliced wafer 14 bringing the wafer to the holding station.

The holding chuck 22 is now moved into the extended position to place a previously sliced wafer 14' (see FIG. 1) in the grinding position for grinding by the grind stage 15. At this time, the front face of the wafer is aligned with the front face of the ingot 11, i.e. is in a common plane therewith. The grind stage 15 is then moved towards the held wafer 14'. The stage stops upon reaching the grind registration position in readiness to grind the exposed face of the wafer. Upward movement of the grind stage 15 with the saw blade assembly 12 then effects grinding of the face of the positioned wafer 14' and grinding of the face of the ingot 11 in a simultaneous (in unison) sequential manner. Upon completion of the upward stroke of the saw blade assembly 12, the ingot 11 is indexed forwardly so that the saw blade 13 may begin slicing a fresh wafer. At the same time, the holding chuck 22 is returned to the retracted (transfer) home position.

Next, the transfer chuck 23 is moved into alignment with the holding chuck 22. Vacuum on the transfer chuck 23 is then generated and the vacuum on the holding chuck 22 is released to transfer the ground wafer. The transfer chuck 23 is then indexed forwardly via the longitudinal movement of the upright member 73 into the dotted line position shown in FIG. 1. Next, the transfer chuck 23 is moved laterally out of alignment with the holding chuck 22, for example into the dotted line position shown in FIG. 3 and then moved via the upright member 73 longitudinally of the ingot holder 10 to the left as shown in FIG. 1 until the member 73 is in alignment with the unloading station. At this time, the guideway base 74 is moved into the retracted position relative to the machine base 33, as shown in solid line in FIG. 3, so that the transfer chuck 23 is positioned at the unloading station.

Next, the transfer chuck 23 is pivoted 90° from a vertical position into a horizontal position as indicated in FIG. 4 (dotted lines). In this position, the holding chuck 23 is vertically above the conveyor 83 (dotted lines), The lead screw 81 is then rotated so as to cause the holding chuck 23 to move vertically downwardly to bring the wafer thereon into a position over the conveyor 83. Vacuum is then released from the transfer chuck 23 so that the wafer is deposited onto the conveyor 83 and moved therealong through the thickness measuring means 90. (FIG. 5)

Thereafter, the transfer chuck bracket 71 is raised vertically and the transfer chuck 23 pivoted 90° into a vertical position. Next, the guideway 74 is moved into the extended position from the machine base 33, as shown in dotted line in FIG. 5 and the upright member 73 returned into the position shown in FIG. 1.

The transfer chuck 23 is then rotated 90° into a horizontal position and the guideway 74 retracted into the machine so that the transfer chuck 23 moves under the wafer being held by the pick-off means 17 in the holding station. The wafer is transferred from the pick off means 17 to the transfer chuck 23.

Thereafter, the transfer chuck 23 is moved laterally by extending the base 74 so that the wafer thereon will clear the pick-off means 17 upon subsequent rotation of the transfer chuck 23 into a vertical position. The base 74 is then retracted into the machine so that the transfer chuck 23 moves into alignment with the holding chuck 22. The wafer is then transferred to the holding chuck. Once the wafer is transferred to the holding chuck 22, the transfer chuck 23 is moved laterally away from the base by moving the guideway 74 to the extended position. This places the transfer chuck 23 in a ready position while the next wafer is sliced and the previous wafer ground.

During the time that a wafer is held on the holding chuck 22 in the retracted home position, the saw blade 13 is slicing a wafer from the ingot 11. At this time, the pick-off means 17 is moved through the saw blade 13 into a position to pick-up the wafer being sliced from the ingot 11. Upon completion of the slicing operation, the wafer is brought out and held by the pick-off means 17 in the holding position shown in solid line in FIG. 1.

The face of the ceramic holding chuck 22 is initially ground and then re-ground periodically by the face of the grind wheel 16 of the grind stage 15 in order to assure flatness and parallelism of surface to the pivoting cutting (grinding) stroke. The face of the ceramic holding chuck 22 is also cleaned between wafer grinds by backflushing water through the porous face and scrubbing the face with a nylon brush or equivalent (not shown) Chuck face cleaning would take place with the chuck in the transfer (home) position starting just after the double ground wafer is removed from the chuck.

The invention thus provides a slicing and grinding machine wherein wafers can be sliced from an ingot and ground on opposite faces.

The invention further provides a machine in which a wafer is subjected to limited handling so that the risk of damage to the wafer in transit is minimized.

Further, the invention provides a machine which can be readily adjusted during operation to adjust to variations in thickness of a wafer ground on both.

The invention thus provides a machine that effectively and efficiently provides for the slicing and the grinding of both sides of a wafer in place of two machines for the slicing and grinding of a wafer. In addition, the machine controls wafer thickness automatically since the machine inherently identifies and compensates for grind wheel wear. Blade wear can also be identified and compensated for to keep kerf loss to a minimum.

Still further, the invention may be incorporated into other machines for the slicing and grinding of wafers. For example, both the ingot and a previously sliced wafer may be rotated during a grinding operation. In this respect, both the face of the ingot and the back side of a previously sliced wafer would be ground. This may be accomplished by incorporating a motorized spindle for mounting and rotating the ingot about a central axis. In a similar manner, the vacuum chuck on the holding chuck would be supported and motorized to rotate about a central axis. Such techniques are individually well known for slicing, grinding and facing ingots and wafers and need not be further described.

Of note, one purpose for rotating and slicing a workpiece is to shorten the wafer slicing operation. By plunge grinding in cooperation with rotary slicing one not only obtains a flat reference surface on the wafer but also removes the projected (or transitional surface if rotation is stopped for cutoff) central portion of the sliced surface of an ingot due to rotation of the ingot. An additional purpose for rotating an ingot during slicing is to effectively slice extremely hard materials such as sapphire and GGG by inherently keeping blade deviation to a minimum. Ingot rotation also allows slicing of larger diameter wafers on the same machine. This is because the internal diameter blade has to cut only half way through the ingot.

What is claimed is:

1. A method of slicing and grinding a wafer from an ingot comprising the steps of positioning an ingot in a slicing position;

grinding a face of the ingot in said slicing position;

slicing a wafer from the ground face of the ingot in said slicing position;

moving the wafer sliced from the ingot to a holding station;

thereafter transferring the wafer from said holding station to a position with an unground face thereof in a plane common to the face of the ingot; and thereafter grinding the unground face of the wafer and the face of the ingot in said plane.

2. A method as set forth in claim 1 which further comprises the steps of measuring the thickness of a ground wafer and adjusting the position of a subsequently positioned wafer relative to said plane in dependence on a measured thickness deviating from a present value.

3. A method as set forth in claim 1 which further comprises the steps of conveying the ground wafer from said plane to an unloading position.

4. A method of slicing and grinding a wafer from an ingot comprising the steps of positioning an ingot on a longitudinal axis in a slicing position;

grinding a face of the ingot in said slicing position;

slicing a wafer from the ingot positioned at said slicing position after grinding of the face of the ingot;

moving the wafer from the ingot positioned at said slicing position after grinding of the face of the ingot;

moving the wafer sliced form the ingot at said slicing position to a holding station;

moving a previously sliced wafer to a position with a second face thereof in a plane common to an unground face of the ingot in said slicing position; and thereafter grinding the second face of the previously sliced wafer and the face of the ingot in said plane.

5. A method as set forth in claim 4 wherein the face of the second wafer is ground sequentially before the face of the ingot in said plane.

* * * * *